US011156238B2

(12) United States Patent
O'Hara

(10) Patent No.: US 11,156,238 B2
(45) **Date of Patent: *Oct. 26, 2021**

(54) HYDRAULIC ROTARY ACTUATOR

(71) Applicant: William O'Hara, Irvine, CA (US)

(72) Inventor: William O'Hara, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/886,756

(22) Filed: May 28, 2020

(65) Prior Publication Data

US 2020/0291968 A1 Sep. 17, 2020

Related U.S. Application Data

(63) Continuation of application No. 16/268,217, filed on Feb. 5, 2019, now Pat. No. 10,704,572.

(60) Provisional application No. 62/631,215, filed on Feb. 15, 2018, provisional application No. 62/793,201, filed on Jan. 16, 2019.

(51) Int. Cl.
*F15B 15/12* (2006.01)
*F01C 9/00* (2006.01)

(52) U.S. Cl.
CPC ..... *F15B 15/125* (2013.01); *F01C 9/002* (2013.01)

(58) Field of Classification Search
CPC ..... F15B 15/12; F15B 15/125; F01C 1/063; F01C 9/002
See application file for complete search history.

(56) References Cited

U.S. PATENT DOCUMENTS 4,864,917 A * 9/1989 Methot ..... F01C 9/002 92/55
5,007,330 A 4/1991 Scobie
5,495,791 A * 3/1996 Sande ..... F01C 9/002 92/120
7,895,935 B2 * 3/2011 Kells ..... F15B 15/125 92/120
7,930,971 B2 * 4/2011 Werkhoven ..... F15B 15/12 92/121
8,955,425 B2 2/2015 Sobolewski
9,163,648 B2 10/2015 Kim
9,234,535 B2 1/2016 Kim
9,447,785 B2 9/2016 Ito
9,476,434 B2 10/2016 Sobolewski
9,593,696 B2 3/2017 Kim
(Continued)

FOREIGN PATENT DOCUMENTS

EP 2597254 5/2013

*Primary Examiner* — Thomas E Lazo
(74) *Attorney, Agent, or Firm* — Klein, O'Neill & Singh, LLP

(57) ABSTRACT

A shaft extending along a longitudinal axis has fluid channels that increase and decrease pressure in chambers formed between the interior ends of curved pistons and adjacent closed ends of curved chambers within which the pistons reciprocate as the chamber pressure increases and decreases. The chambers and pistons are in separate cylinder block segments extending outward from opposing sides of the shaft. Each segment may have two sides extending along radial planes and joined by a curved outer surface. Pistons may be provided in pairs and have an interior piston end of each piston in a different cavity in different segments. Exterior ends of each piston in a pair of pistons are connected to a piston connector that extends inwardly from a housing so the housing rotates with the pistons.

15 Claims, 9 Drawing Sheets

(56) References Cited

U.S. PATENT DOCUMENTS

| | | | | |
|---|---|---|---|---|
| 9,631,645 | B2 * | 4/2017 | Sobolewski | F01C 9/002 |
| 9,816,537 | B2 | 11/2017 | Kim | |
| 2014/0238228 | A1 | 8/2014 | Sobolewski | |
| 2017/0218983 | A1 | 8/2017 | Sobolewski | |

* cited by examiner

HYDRAULIC ROTARY ACTUATOR

CROSS-REFERENCE TO RELATED APPLICATIONS

This application is a continuation of U.S. patent application Ser. No. 16/268,217, filed on Feb. 5, 2019, which claims priority to Provisional Patent Application No. 62/631,215, filed Feb. 15, 2018, and Provisional Patent Application No. 62/793,201, filed on Jan. 16, 2019, the entire contents of which are incorporated herein by reference.

BACKGROUND

The present invention relates to a rotary actuator, especially to hydraulic rotary actuators used to rotate aileron and other flaps on airborne frames. Vehicles moving through air rotate, extend and retract control surfaces to deflect the air so the vehicle rotates in response to the force on the control surface or changes speed in response to the forces on the control surfaces. Control surfaces on wings and tails of airplanes are commonly recognized examples. If the rotary actuators are sufficiently small, they may be placed along the rotations axis of the control surface. But such in-line actuators often lack the torque capacity required to rotate the control surfaces. Further, to achieve the required torque capacity, the rotary actuators become larger and heavier than desired, requiring them to be mounted off-axis and use intervening mechanisms to connect to the control surface. For example, a gear mechanism or linkage mechanism may be used to increase the applied force and connect the rotary actuator to the control surface, but the mechanism increases cost and complexity, delays the response time and reduces the stiffness of the drive mechanism for the control-surface. Additionally, linear actuator assemblies may be used having a linear actuator with an intervening mechanism to vary the power and/or convert linear motion into rotary motion, but such assemblies suffer from the same and additional disadvantages as the gear and linkage mechanisms. There is thus a need for an improved rotary actuator.

There is also a need for a rotary actuator that eliminates cross chamber leakage, is inexpensive, has high torque density, and is rugged. Cross chamber leakage adds to operating cost as the energy used to pressurize hydraulic fluid is constantly dissipated so that it and position control must always be active for a conventional vane actuator to maintain a desired position. Conventional rotary piston actuators may accomplish position hold without constant active control, but their construction is inefficient as far as cost, part count, size and weight. Size and weight may be primary factors for use in many applications. Size and weight are especially important in flight control applications where thin wings are desired for low drag in wing design.

Even before the beginning of jet flight it was recognized that thin wings enable faster velocities. One component that has been considered desirable is a powered hinge, or rotary hydraulic actuator, to eliminate the bell crank that is necessary to convert the linear motion of a conventional actuator to the rotary motion of a flight control surface about its hinge line. Several concepts have been developed for the powered hinge type. Among them are the vane actuator, the geared actuator, the radial piston actuator, and the rotary piston actor.

But the vane actuator can achieve a high torque density and range of motion but lacks a sealing method to prevent cross chamber leakage that would enable hydraulic blocking to hold control surface position without constant adjustment and are sluggish in their response to commands. The seals for vane actuators have proven unreliable under the harsh demands of flight control which causes the actuators to suffer a very short lifespan before they need to be overhauled and the seals replaced. The geared actuator can be packed relatively thin in profile and with a high torque density, but by sacrificing of command response and with a high degree of complexity in their gear train. The gear train also has an inherently low rate of reliability that is intolerable in a flight control actuator. Radial piston actuators have a relatively low torque density, which makes them poor candidates for flight control actuators for a thin wing design. There is thus a continued need for an improved rotary actuator.

Rotary piston actuators have been in use for decades but not considered for a flight control until recently. The conventional design uses a center output shaft that consist of a lever that extends radially outward to connect with curved pistons that reciprocate into and out of similarly curved cavities of a housing through conventional piston seals. This arrangement is enclosed inside an enclosure to protect it from atmosphere and foreign debris, while also protecting the surrounding atmosphere from leakage that inherently occurs as the pistons reciprocate through the cavity seal. The rotary piston actuator suffer in torque density as each components' size increases the overall size, especially if it is desired to achieve a high torque output and stiffness.

BRIEF SUMMARY

The hinge line actuator disclosed herein is of a rotary piston type but may provide a great improvement in torque density and simplicity of design. The design combines the function of the output shaft with a housing that contains curved pistons and piston seals. The design allows the curved pistons to be radially spaced close to the hinge line. An enclosure that includes levers that extend radially inward attach to the curved pistons that reciprocate into and out of the cavities in the inner housing shaft. With curved cavities in the inner housing shaft, the diameter changes as the piston size requires such that the housing shaft stiffness tunes itself for the required stiffness to significantly increase torque density. Further, with the pistons attached to the levers of the outer enclosure the resulting envelope of the actuator remains very thin and advantageous for thin wing applications.

The hinge line actuator described herein is of a rotary piston type but with great improvement in torque density and simplicity of design. The unconventional design combines the function of the output shaft with the housing that contains curved pistons and piston seals. The utility of this design allows the curved pistons to be radially spaced close to the hinge line. An enclosure includes ground lugs that extend radially inward to attach to the curved pistons that reciprocate into and out of cavities in the inner housing shaft. With curved cavities in the inner housing shaft, the diameter changes as the piston size requires, such that the housing shaft stiffness tunes itself for the required stiffness to significantly increase torque density. Further, with the pistons attached to the ground lugs of the outer enclosure the resulting envelope of the actuator may be very thin and that offers significant advantageous for many applications, including thin winged aircraft.

The advantages of this actuator include improved torque density and simpler construction. Integrating the cylinder block with the inner shaft allows the pistons to be located close, radially, to the axis of the actuator, so that a higher torsional stiffness can be obtained by exploiting the increased outer diameter of the shaft (as pistons are enlarged) rather than separately increasing the shaft diameter plus enlarging pistons and their outer housing, for the same result within a much smaller diameter. Also, using an outer housing as both a ground for the pistons and a crankcase enclosure eliminates a large portion of the hardware that is used in existing rotary piston actuators to shield the crankcase from the environment and from foreign objects. Eliminating an extra layer of housing keeps the diametral envelope smaller still. Enabling the cavity for the piston to operate with direct access to the center axis of the actuator allows the inner end of the piston to communicate through a simple link with a shaft at the axis to stabilize that end of the piston and reduce or eliminate sliding friction as that end of the piston is otherwise forced into contact with the cylinder.

A hydraulic rotary actuator is thus provided that uses reciprocating pistons that take the form of a segment of a toroid, reciprocating about a rotational axis in a segment of a coaxial toroidal chamber that is formed in a housing. Either the toroidal chamber or the piston is fixed relative to a reciprocating shaft through which rotational/reciprocating movement is provided. Pressurized hydraulic fluid enters a cavity in the toroidal chamber behind the piston to rotate the piston relative to the housing during a drive stroke, with hydraulic flowing out of the chamber during a return stroke.

A shaft (e.g., stationary shaft) extends along a longitudinal axis and has fluid channels in fluid communication with chambers formed between the interior ends of curved pistons and adjacent closed ends of curved chambers within which the pistons reciprocate as the fluid pressure in the fluid channels causes chamber pressure to increase and decrease. The chambers and pistons are advantageously in separate cylinder block segments extending outward from opposing sides of the stationary shaft. Each segment may have two sides (e.g., opposing sides). Each segment may extend along radial planes and joined by a curved outer surface and each cavity opens onto one of those sides and each piston reciprocates into and out of one of those sides. Pairs of pistons have an interior piston end of each piston in a different cavity in different segments to define the chambers, with opposing, exterior ends of each piston extending beyond the side of the segment in which the interior end of the piston is located. The exterior end of each piston in a pair of pistons is connected to a piston connector that extends inwardly from a housing so the housing rotates with the pistons. The exterior end of the pistons and the piston connector are in the space or gap between the circumferentially facing sides of each segment.

In more detail, a fluid actuated, rotary actuator is provided having a shaft (e.g., stationary shaft) with fluid ports and a housing which may rotate relative to the shaft. The shaft has first and second opposing ends with a longitudinal axis and a cylinder block intermediate the first and second ends. The cylinder block has at least one segment extending along a length of the axis and subtending an arc of less than 340° about the longitudinal axis. The at least one segment has an outer surface forming a portion of a cylindrical surface centered on and extending along the axis so as to rotate within a cylindrical surface in the housing. Each cylinder block segment can have first and second sides facing opposing circumferential directions about the longitudinal axis. Each segment can have first and second toroidal cavities each curving around the longitudinal axis at the same radius and having a cross-section (e.g., circular or generally circular) along a first circumferential length of the toroidal cavity. Other cross sectional shapes are also contemplated including but not limited square, oval, rectangular. Each toroidal cavity is located in the same general plane orthogonal to the longitudinal axis. Each toroidal cavity also has a closed end internal to the at least one segment (e.g., perpendicular to the axis) and also has an open end matching the cross section of a curved piston. Circular sealing rings may be placed around the open end of each toroidal cavity which opens into the interior of the housing.

A first pair of curved pistons may be provided. The first pair may have first and second pistons. Each piston may be curved at the same radius as the toroidal cavities and also having a cross section (e.g., circular) and sized and configured to reciprocate along the first circumferential length into and out of one of the openings and circular sealing rings. Each piston may also have an interior end facing the closed end of the toroidal cavity. Each piston may also have exterior ends which connect to a piston connector of the rotary actuator housing A housing contains the shaft bearings, seals, and pistons. The housing has a cylindrical inner surface that is connected to the first and second ends of the shaft by bearings so the cylindrical inner surface rotates relative to the outer surface of the at least one segment of the shaft along the longitudinal axis of the shaft. The housing also has at least one inward extending connector connected to the exterior end of each piston so the housing rotates relative to the shaft as the pistons move along the longitudinal axis within the toroidal cavity in which each piston is located. A separate fluid passage extends from an outer surface of the shaft to each of the chambers.

In further variations, the rotary actuator may have a cylinder block that includes first and second segments, each extending along a length of the axis and subtending an arc of less than about 170°. Each segment may have an outer surface forming a portion of the same cylindrical surface, and each segment has first and second sides facing opposing circumferential directions about the longitudinal axis. This rotary actuator may also have a second pair of third and fourth curved pistons each curved at the same radius as the toroidal cavities and further having a cross section sized and configured to reciprocate along the circumferential length into and out of one of the openings and circular sealing rings of the second segment. This rotary actuator may also have third and fourth pistons having respective third and fourth interior ends. Each third and fourth interior end faces a different one of the closed ends to define a third chamber between the third interior end and the closed end facing the third interior end, and defining a fourth chamber between the fourth interior end and the closed end facing the fourth interior end. Each piston advantageously has an exterior end opposite its interior end. This rotary actuator has a housing with a second inward extending connector connected to the exterior end of each piston in the second pair of curved pistons so the housing rotates as the second pair of curved pistons move along the toroidal cavity in which each piston in the second pair of pistons is located. The second inwardly extending connector is located between different faces of the cylinder segments than the first inwardly extending connector.

In still further variations, this rotary actuator is connected to the inward extending connector by a male projection on the connector engaging a female receptacle on the piston. The female receptacle may include a slot in the piston having a cross-sectional shape that mates with a male projection on the inwardly extending connector. Each of the chambers advantageously comprises a radial segment of the toroidal cavity containing the chamber. Each cylinder block segment may extend along an arc of about 55° about the longitudinal axis, and each piston travels along an arc of about 32° about the longitudinal axis. Each inward connector may have two opposing sides, each extending along a plane through a length of the longitudinal axis. The first and second faces of each cylinder block segment may lie substantially in a radial plane extending along a length of the longitudinal axis.

In still further variations, a housing connector may be used to connect the rotating housing to another device to be driven by the actuator. The housing connector may have first and second ends with the first end being rotatably connected to the housing and the second end configured to connect to the driven device. The housing connector may have first and second ends with the first end being connected to and rotating with the housing. The shaft is preferably connected to a first surface so the shaft does not rotate about the longitudinal axis while the housing is connected to a part which rotates with the housing. At least one of the fluid passages may open onto the first or second end of the shaft. Additionally, the housing advantageously has a cylindrical outer surface with opposing ends, and may include an end cap on each end of the housing along with a fluid seal interposed between each end cap and one of the housing or bearings and a fluid seal interposed between each end cap and a different end of the shaft.

There is also provided a fluid actuated, rotary actuator having plural cylinder segments. This rotary actuator has a housing with a cylindrical inner surface of diameter D and extending along a longitudinal axis. A shaft having first and second opposing ends extends along the longitudinal axis inside the housing. First and second bearings are connected to respective first and second ends of the shaft and interposed between the shaft and housing so the shaft and housing rotate relative to each other about the longitudinal axis. A cylinder block on the shaft has first and second segments, each having an outer surface forming a portion of a cylinder of slightly smaller diameter than diameter D. Each segment extends along an arc of about 155° to about 160° relative to the longitudinal axis and each segment has circumferentially opposing faces. Each segment contains two toroidal cavities each curving about the longitudinal axis and having a circular diameter d in a radial plane along the longitudinal axis. Each toroidal cavity also has an internal closed end and an open end on one of the faces of the first and second segments. The toroidal cavities are aligned in a first plane orthogonal to the longitudinal axis.

This actuator also has first and second pairs of curved pistons each having a circular diameter slightly less than d in a radial plane orthogonal to the longitudinal axis and configured to reciprocate along the toroidal cavities and about the longitudinal axis. Each pair of pistons has a first and second piston each with an interior end and an exterior end. Each first and second piston of each pair of pistons is located in a different one of the toroidal cavities in a different segment. The actuator includes a first piston connector extending inward from the housing between two of the faces of the segments and connected to the exterior end of the first pair of pistons so the pistons rotate with the housing. With this construction, each piston rotates about the longitudinal axis within a different toroidal cavity with a different chamber defined by each interior end and the closed end of the cavity in which the piston rotates. A separate fluid passage is placed in fluid communication with each chamber to selectively pressurize and release pressure from each chamber to rotate the pistons and housing.

In further variations of this fluid actuated, rotary actuator, the fluid passages open onto one of the first and second ends of the shaft. Further, this actuator may have a plurality of fluid seals between the shaft and housing to reduce hydraulic fluid from leaving the housing. The connector may include a male projection and the exterior end of each piston may include a female recess. In further variations, the closed ends of the toroidal cavities and interior ends are each in a radial plane extending along the longitudinal axis. Additionally, a housing connector having first and second ends, with the first end connected to an outer surface of the housing. During use, the shaft of this actuator is advantageously fixed in position relative to a support surface so the housing rotates relative to the support surface.

BRIEF DESCRIPTION OF THE DRAWINGS

These and other advantages and features of the invention will be better appreciated in view of the following drawings and descriptions in which like numbers refer to like parts throughout, and in which.

DETAILED DESCRIPTION

Figure 1:
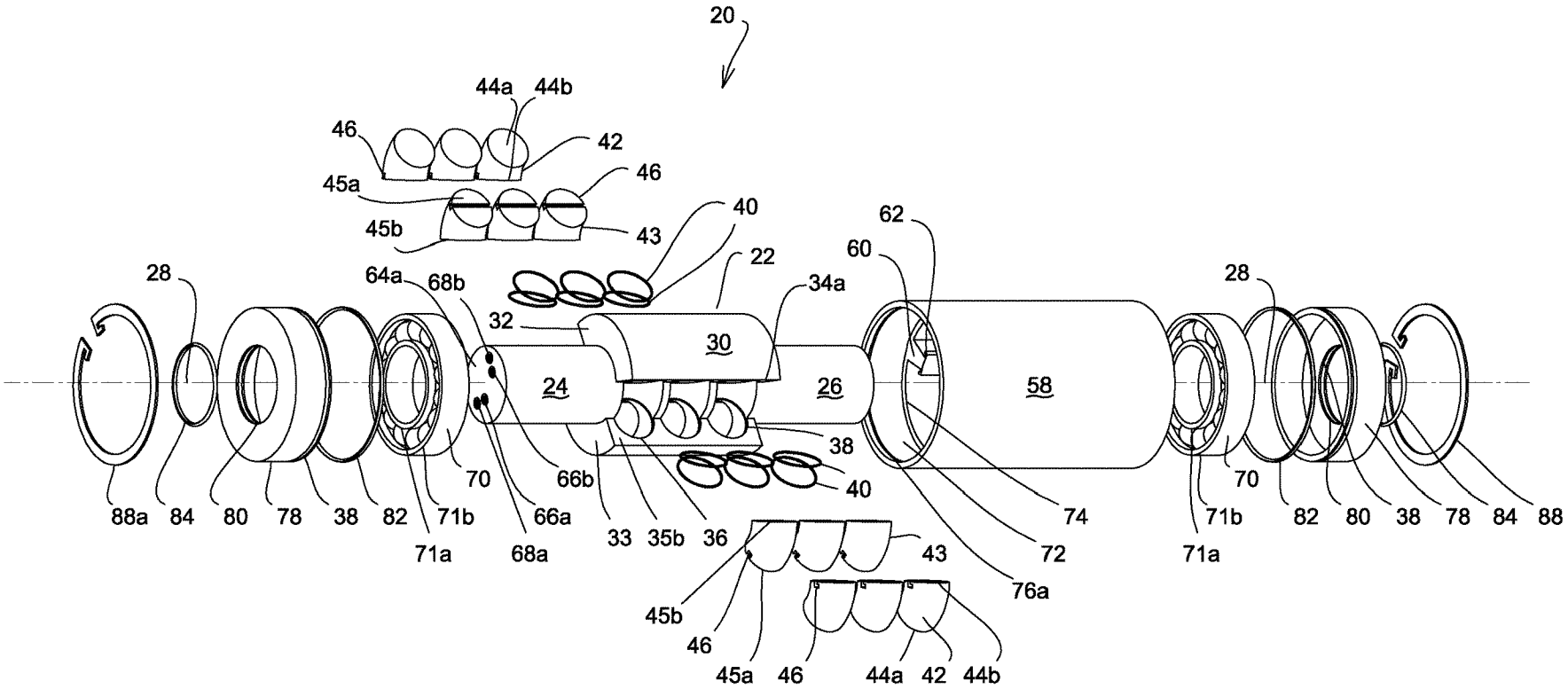
FIG. 1 is an exploded perspective view of a fluid powered, rotary actuator.

As used herein the relative terms inward and outward, inner and outer are the relative directions toward and away from a longitudinal axis when the parts are orientated in the assembled position for use. The circumferential direction is with respect to a circumference of a circle about the longitudinal axis.

As used herein, the following part numbers generally refer to the following part names: 20—rotary actuator; 22—shaft; 24—first shaft end portion; 26—second shaft end portion; 28—longitudinal axis; 30—cylinder block; 32—first cylinder block segment; 33—second cylinder block segment; 34*a,b*—faces/sides of first cylinder block segment; 35*a,b*— faces/sides of second cylinder block segment; 36—toroidal cavities; 38—seating recess; 40—sealing ring; 42—first curved piston; 43—second curved piston; 44*a,b*—piston faces on piston; 45*a,b*—piston faces on piston; 46—slot in piston face; 50—central shaft portion of piston chamber; 52*a,b*—spokes; 58—housing; 60—piston connector; 62—connector flange; 64*a,b*—ends of shaft 22; 66*a,b*—first fluid passage; 68*a,b*—second fluid passages; 70—bearings; 71*a,b*—inner, outer races; 72—recess in housing; 74—shoulder on housing; 76 retaining clip seating recess; 78—end cap; 80—opening in end cap; 82—housing cap seal; 84—shaft cap seal; 86—actuator mount; 88—retaining clip; 89—Housing Connector; 90—first chamber; 92—second chamber; 94—third chamber; and 96—fourth chamber. Preferably, the first shaft portion 24, second shaft portion 26, cylinder block 30, first cylinder block segment 32 and second cylinder block segment 33 may be fabricated from a unitary material.

Figure 2:
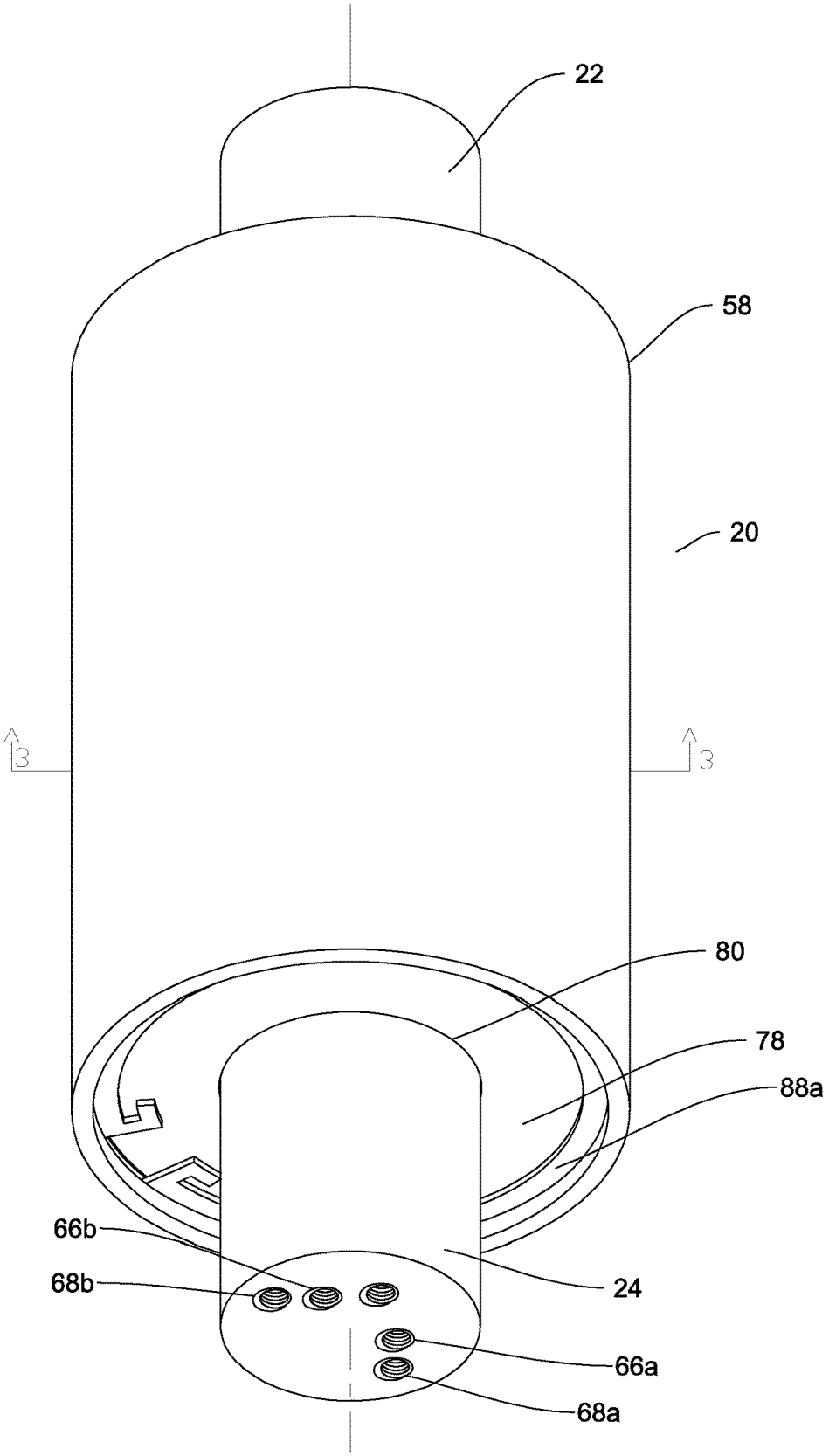
FIG. 2 is an assembled perspective view of the rotary actuator of FIG. 1.
Figure 3A:
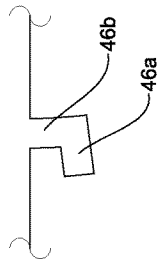
FIG. 3A is an enlarged view of a portion of the actuator shown in FIG. 3.
Figure 3:
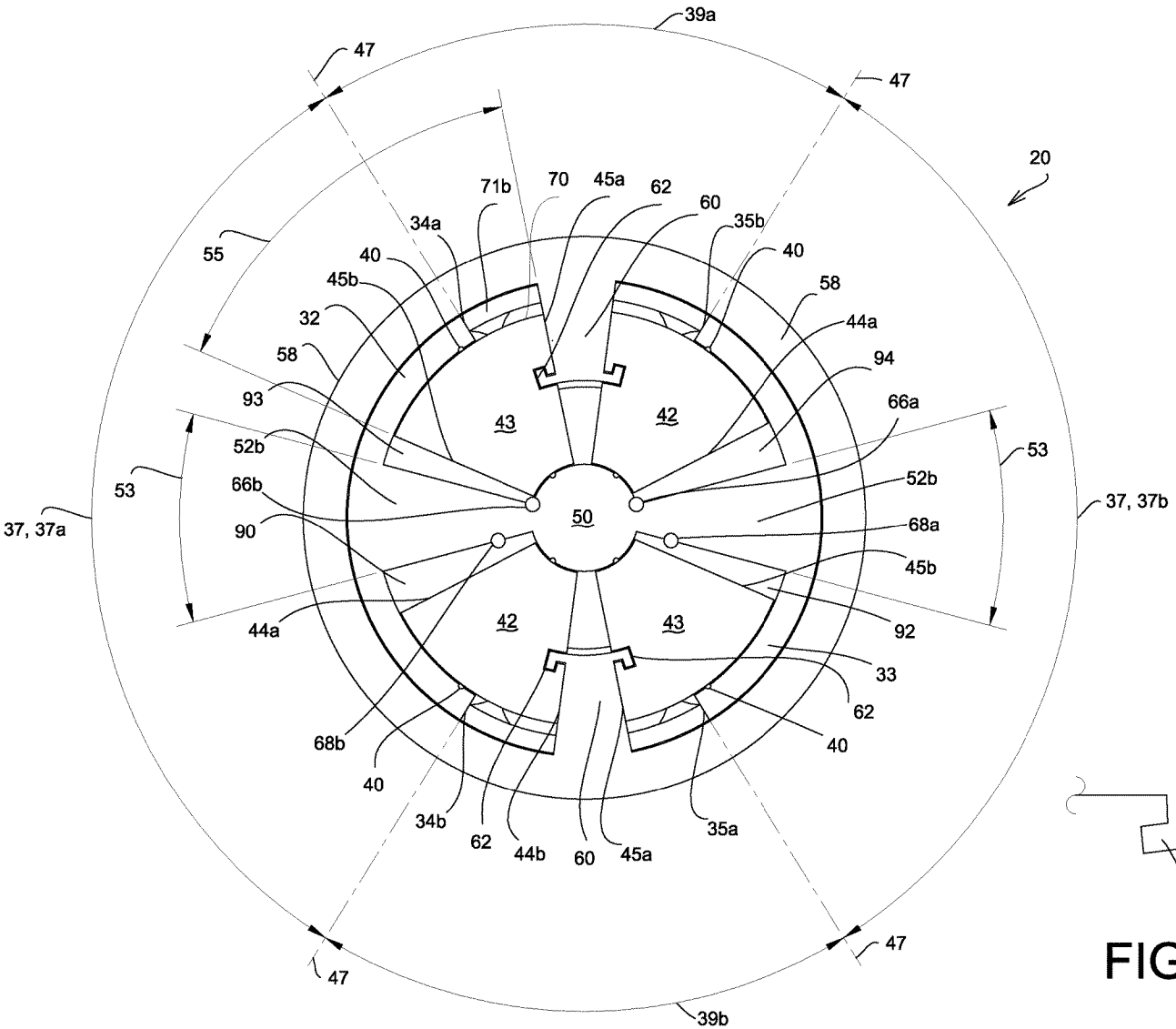
FIG. 3 is a sectional view taken along section 3-3 of FIG. 2 with the cross-hatching omitted for clarity.
Figure 5:
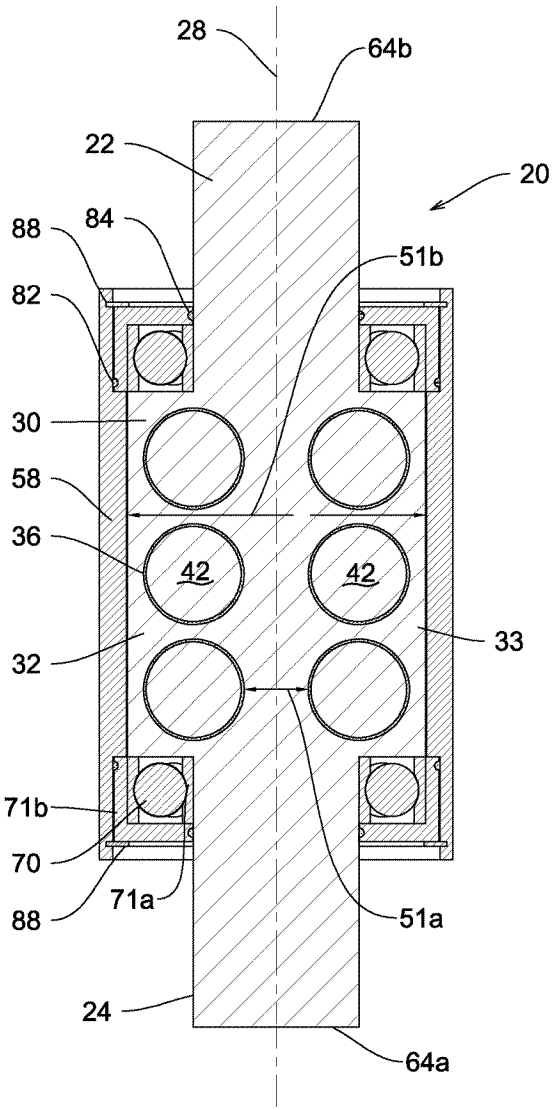
FIG. 5 is a sectional view of the rotary actuator of FIG. 2 taken along section 5-5 of FIG. 10, but not showing fluid passages.
Figure 4:
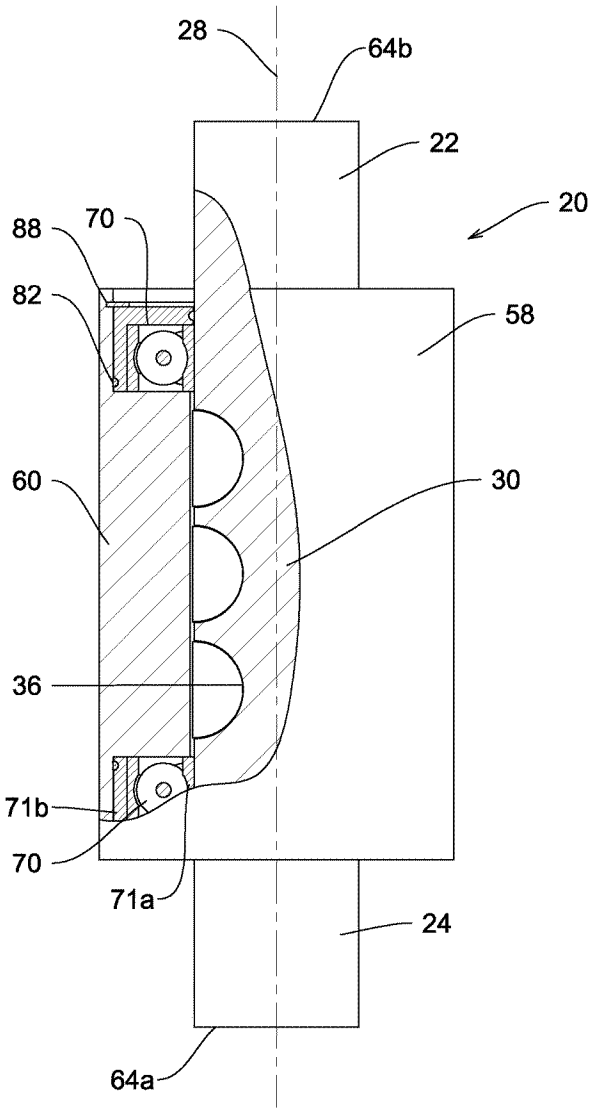
FIG. 4 is a partial sectional view of the rotary actuator of FIG. 2 taken along section 4-4 of FIG. 10, showing piston cavities but not fluid passages to those cavities.
Figure 8:
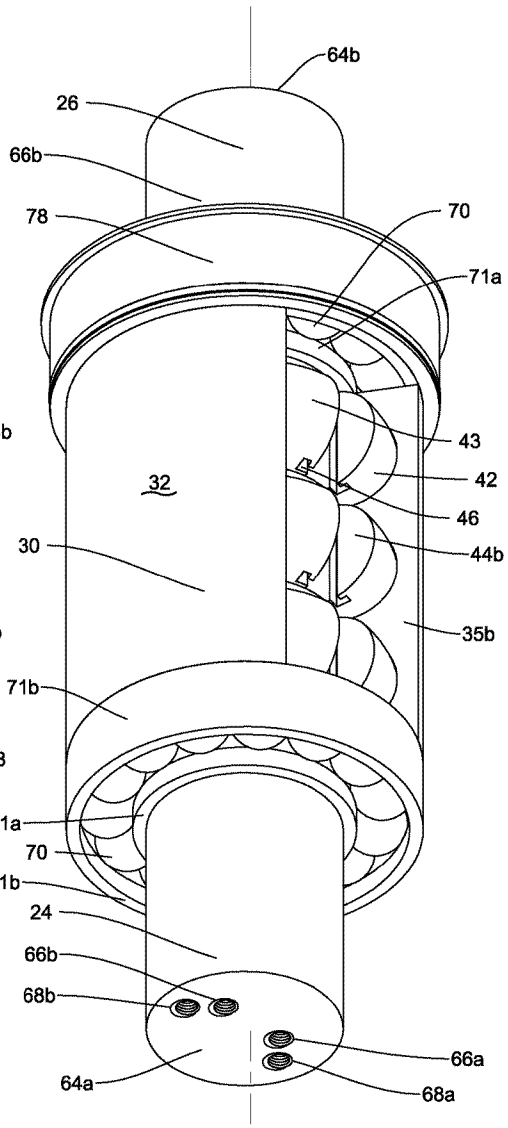
FIG. 8 is a perspective view of the rotary actuator of FIG. 7 with part of the end cap removed to show details of the bearings.
Figure 7:
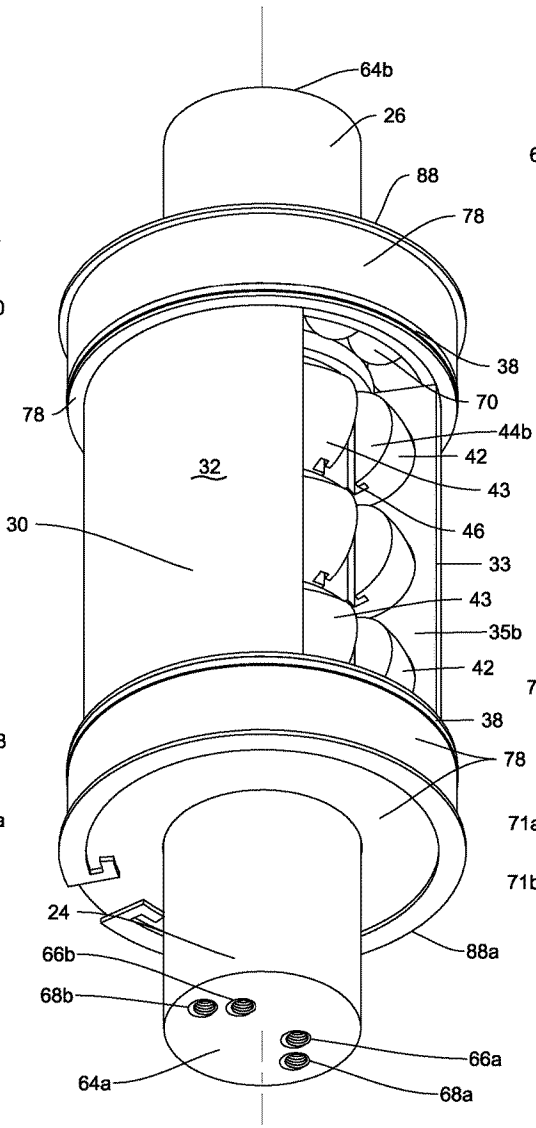
FIG. 7 is a perspective view of the rotary actuator of FIG. 6 with the pistons and piston connector in place.
Figure 6:
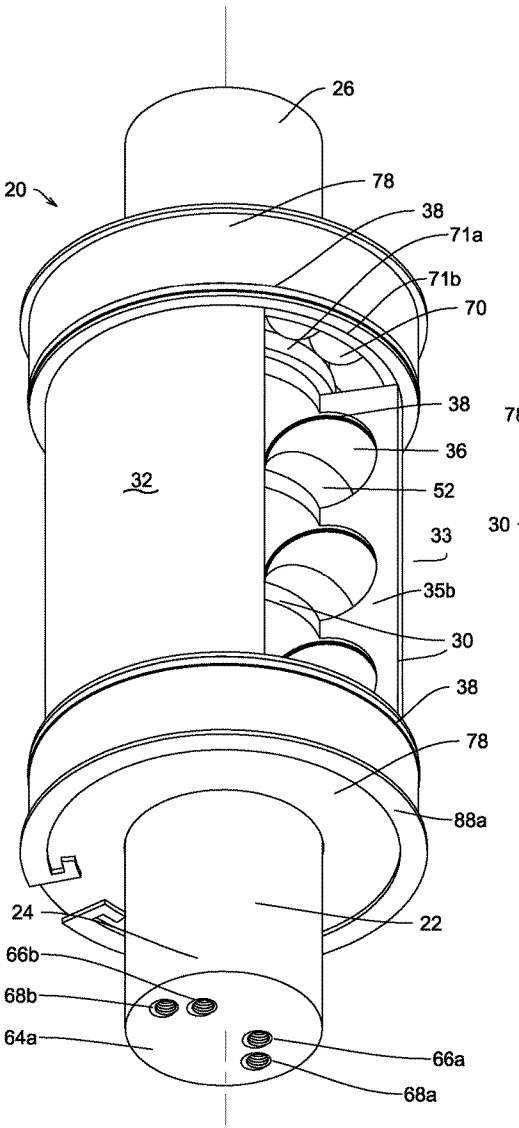
FIG. 6 is a perspective view of part of the rotary actuator of FIG. 2, with the housing and pistons and piston connector removed.
Figure 9:
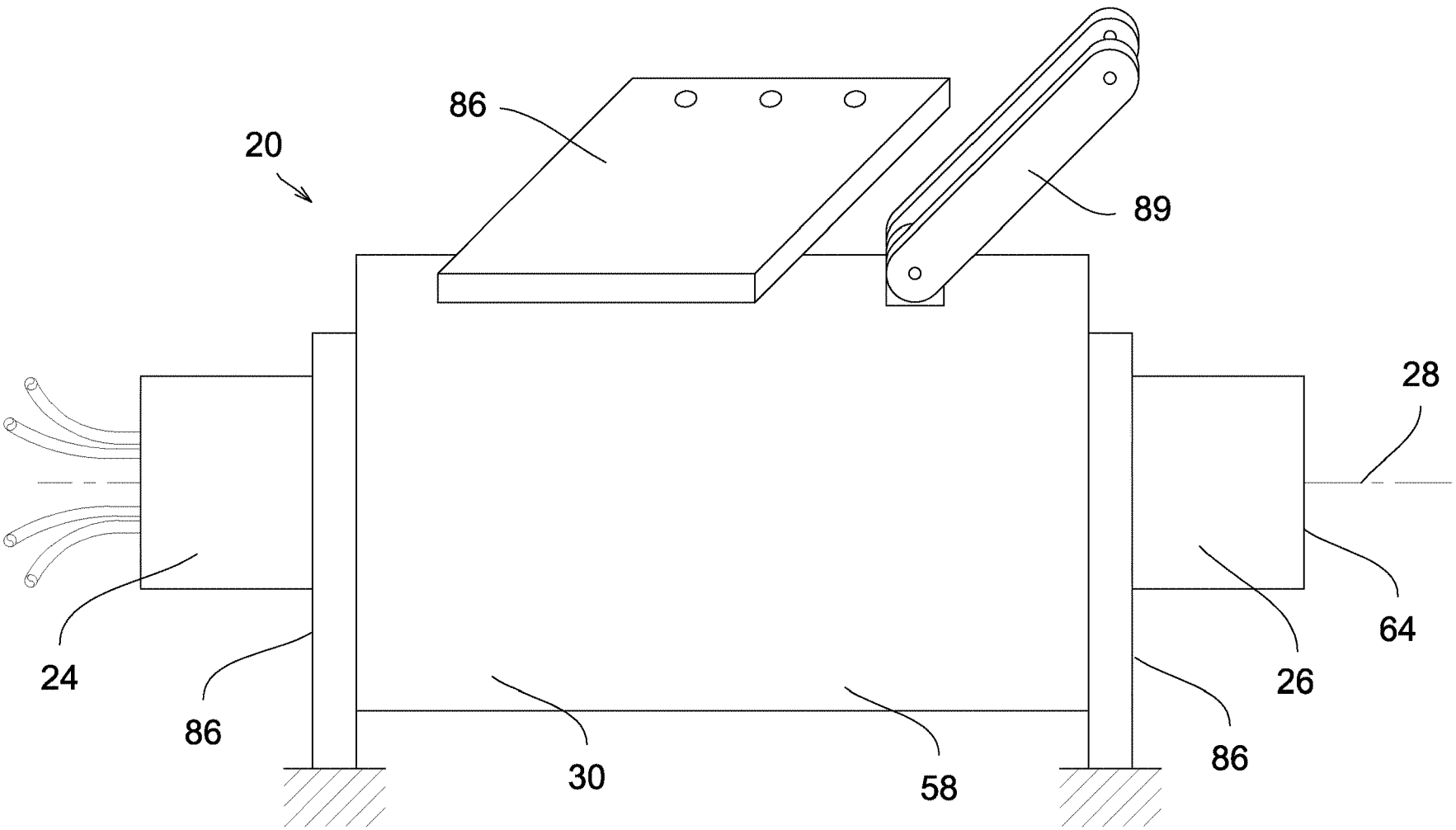
FIG. 9 is a side view of the rotary actuator of FIG. 2 mounted in one potential use configuration.
Figure 10:
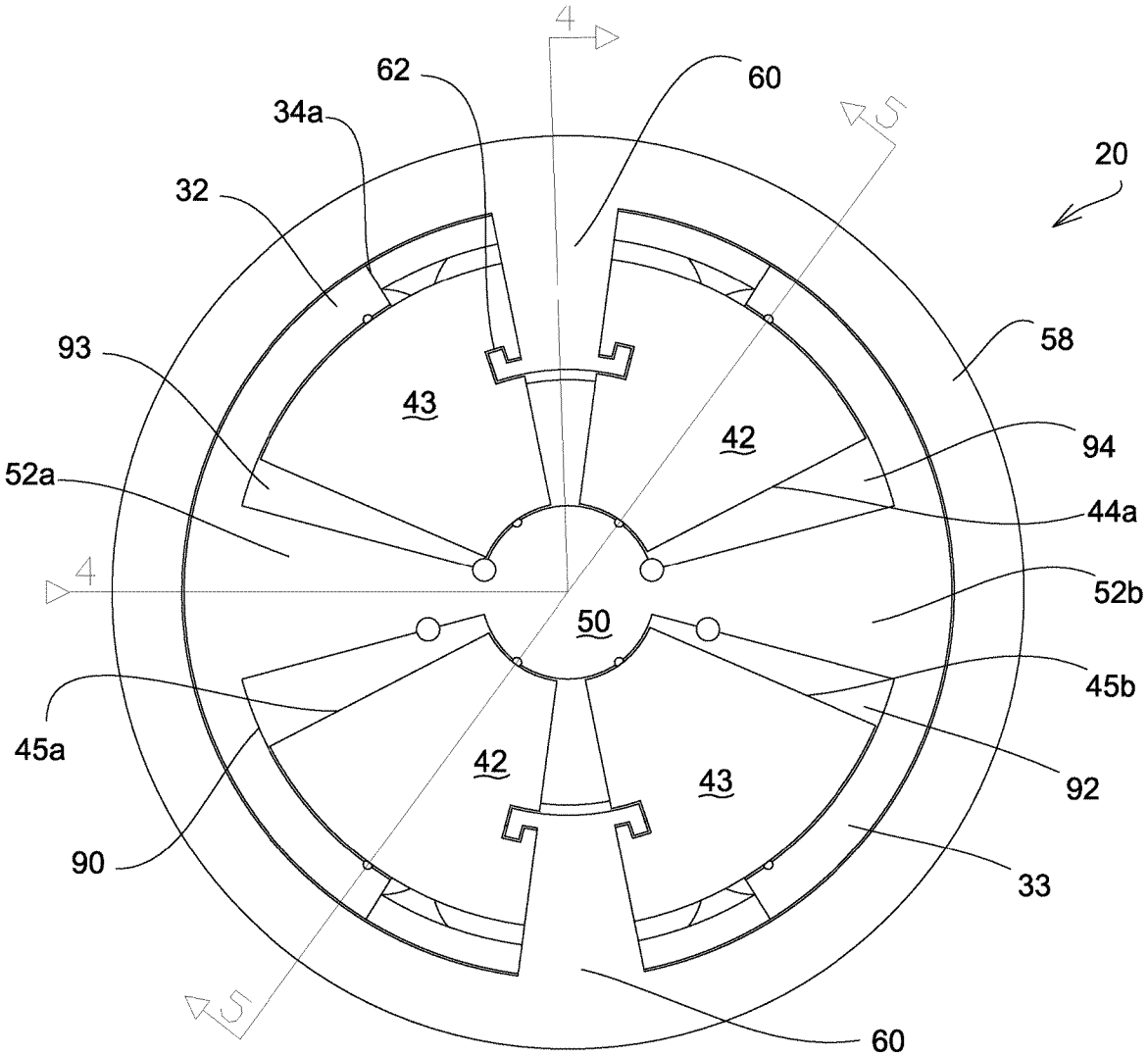
FIG. 10 is a sectional view of a rotary actuator of FIG. 2 taken along section 3-3 of FIG. 2, showing the section lines for FIGS. 4 and 5.

Referring to FIGS. 1-10, a rotary actuator 20 has an elongated shaft 22 having first and second opposing end portions 24, 26 and extending along a longitudinal axis 28. A generally cylindrical cylinder block 30 is located on the shaft 22, advantageously between end portions 24 and 26 so the shaft 22 may form a central part of the cylinder block 30, or viewed another way, coaxial shaft end portions 24, 26 extend from opposing ends of the cylinder block 30. The cylinder block 30 may form a generally cylindrical shape with interleaved triangular segments. The cylinder block 30 has a longitudinal axis that is coaxial with axis 28 and is shown with two-cylinder block segments 32, 33. The segments 32, 33 may be disposed on opposite sides of the longitudinal axis 28. Each of the segments 32, 33 may have two opposing sides or faces, namely, sides or faces 34*a*, 34*b* on first cylinder block segment 32 and sides or faces 35*a*, 35*b* on second cylinder block segment 33, as shown in FIGS. 1 and 3. In the illustrated embodiment, each segment 32, 33 extends along an arc 37 (see FIG. 3) less than 180, and may extend along an arc of about 150°-170°, and advantageously subtends an arc of about 155°-165°, with an arc of about 160° believed suitable and illustrated in the drawings. More particularly, the circumferentially opposing faces 34*a*, 34*b* and 35*a*, 35*b* are separated by an arc 37*a*, 37*b* (see FIG. 3) of about 110° to 125°, preferably about 116° to 120°, with the arc 39*a*, 39*b* separating the adjacent faces of the opposing cylinder block segment (e.g., 34*b*, 35*a* and 35*b*, 34*a*) being about 55° to 70° and preferably about 60° to 64°. The radially outer surface of each cylinder block segment 32, 33 forms a portion of the same cylindrical surface extending along axis 28.

The leading face in a clockwise rotation about axis 28 is preferably the "a" face and the trailing face in a clockwise rotation about axis 28 is preferably the "b" face. Collectively, the faces 34*a*, 34*b*, 35*a*, 35*b* may also be referred to as faces 34, 35. The direction of rotation to determine the leading "a" face is with respect to the actuator 20 as shown in FIGS. 2-3, when the axis 28 is viewed from the end showing the depicted fluid passages 66, 68. The actuator reciprocates between clockwise and counterclockwise directions.

Each cylinder block segment 32, 33 has at least one, and may have a plurality, of toroidal cavities 36 (see FIGS. 1 and 6) extending between and having an opening at opposing faces 34*a*, 34*b*, 35*a*, 35*b* and coaxial with longitudinal axis 28. The cavities 36 advantageously comprise segments of a toroid and as used herein a reference to a toroidal cavity or a toroidal shaped cavity each includes portions of a toroid less than 360°. A seating recess 38 may be formed at each face 34*a*, 34*b*, 35*a*, 35*b* surrounding the opening to each toroidal cavity 36. At least one sealing ring 40, such as a piston ring, may be placed in each seating recess 38. The seating recess 38 and sealing ring 40 may be positioned so as to be inwardly offset from or at an edge of the opening. A curved piston 42, 43 may be placed in each toroidal cavity 36, inserted through an open end in one of the faces 34*a*, 34*b*, 35*a*, 35*b*. The sealing rings 40 are fixed to and stationary relative to the cylinder block segment of the shaft 30 and seal against the outer periphery of the curved pistons 42, 43 as they reciprocate in the curved toroidal cavities 36 (i.e., piston chambers).

With the pistons 42, 43 in the piston cambers 36, the curved pistons 42, 43 may each curve in a circle concentric with longitudinal axis 28 and in a plane orthogonal to longitudinal axis 28. Each curved piston 42, 43 may have a circular cross-section taken orthogonal to a curved centerline of each curved piston. Although a circular cross section is described and shown, other shapes for the cross section are also contemplated including but not limited to square, triangular, polygonal, elliptical, etc. Each curved piston may reciprocate within the piston chamber 36 within which the piston is placed during use. As described later, the curved pistons 42, 43 may be coupled together to reciprocate about axis 28, with the first piston 42 being the lead piston during rotation in a clockwise direction about axis 28, and with the second piston 43 being the trailing piston during rotation in a clockwise direction about axis 28, and vice versa. The curved pistons 42, 43 have opposing first and second piston faces 44*a*, 44*b* associated with piston 42, and first and second piston faces 45*a*, 45*b* associated with pistons 43. The "a" piston faces are on the leading end of the piston 42, 43 during a clockwise rotation about axis 28, while the "b" piston faces are on the trailing end of the piston during a clockwise rotation about axis 28, and vice versa. The piston faces 44*a*, 44*b*, 45*a*, 45*b* may be collectively referred to as piston faces 44, 45. The piston faces 44, 45 advantageously lie in radial planes 47 (see FIG. 3) to the longitudinal axis 28.

The trailing face 44*b* of the first (leading) piston 42 and the leading face 45*a* of the second (trailing) piston 45 of pistons 43, may each have a slot 46 (see FIG. 3). That slot 46 may have an L-shaped cross-section extending along an axis parallel to longitudinal axis 28 during use, with an opening of the L-shaped slot opening onto the piston face 44*b*, 45*a* and into the piston, with the leg of the L-shaped slot extending outward. As seen in FIGS. 1, 3 and 7-8, the in the use position, one leg 46*a* of the L-shaped slot 46 extends into (and through) one of the pistons 42, 43 and the other leg 46*b* extends radially outward parallel to the adjacent face 44, 45 of the piston. In use, one leg of the L-shaped slot 46 extends along a circumference encircling axis 28 with the other leg extending radially outward. The shape of the slot 46 may vary but is configured to engage a piston connector as described later. The slot 46 extends along a midline of the piston face in which it is located.

The piston faces 44*a*, 45*b* which are opposite the piston face containing the slot 46, may have a chamfered or filleted periphery to make entry into the openings of the cavities 36 in the cylinder block segments 32, 33 easier and to avoid hitting the outer periphery of those openings and any sealing rings 40 encircling those openings as the pistons enter those openings.

Referring further to FIGS. 1, 3 and 5-8, as the toroidal cavities 36 encircle the longitudinal axis 28, they define a central shaft 50 (see FIG. 3) within the cylinder block and that central shaft 50 may have an outer diameter that varies along the length of axis 28. FIG. 3 shows the smallest diameter 51*a* of central shaft 50 formed by the innermost side of the toroidal cavity 36 passing through the first and second cylinder block segments 32, 33, diameter 51*a* may be smaller diameter than outer diameters of shafts 24, 26. That circular diameter increases, depending on the location along the axis 28 such as diameter 51*b* (see FIG. 5). Separating the toroidal cavities 36 along the longitudinal axis 28 are spokes 52 (see FIG. 3) that extend radially outward. Alternately phrased, each toroidal cavity 36 has a closed end, advantageously aligned to be parallel to the end of the piston 42, 43 which abuts that closed end. Two diametrically opposing spokes 52*a*, 52*b* are shown in FIG. 3, each extending outward from the central shaft 50 (FIG. 3) to a cylindrical outer wall of the first and second cylinder block segments 32, 33. The spokes 52*a*, 52*b* advantageously form the closed ends of the toroidal cavities 36, with each piston 42*a*, 42*b*, 43*a*, 43*b* in its respective cavity 36 traveling along a first circumferential length between the opening of the piston at the face 34, 35 of the cylinder block segment in which the cavity is located, and the closed end of that cavity. Advantageously, the first circumferential length along which each piston travels has the same distance or length, but need not be so. Advantageously, each spoke 52 joins a different one of the first and second cylinder block segments 32, 33, at the middle, circumferentially, of the segment. The radial profile of the spokes 52 in a plane through the longitudinal axis 28 will also vary along the length of that axis. The spokes 52 each subtend an arc 53 of about 10°-30°, and advantageously about 15°-25°, and preferably about 20°, with each opposing side of each spoke 52*a*, 52*b* being in a generally radial plane extending along axis 28. Although the drawings show two spokes, a one spoke embodiment or version is shown and described in relation to FIG. 11.

The cylinder block 30 has a cylindrical outer surface suitable for rotation within a mating cylinder, and is inserted into an actuator housing 58 shown as a cylindrical tube (FIG. 3). Referring to the cross-sectional view of FIG. 3, the housing 58 may have two inwardly extending piston connectors 60 diametrically opposite each other and extending inward toward the longitudinal axis 28. The inwardly extending piston connectors 60 extend parallel to longitudinal axis 28 and extend inward a distance sufficient to connect to a pair of pistons 42, 43 in the same general plane as the piston connectors 60. The inwardly extending piston connectors 60 are preferably intermittent, located to intersect the toroidal cavities 36. The inwardly extending piston connectors 60 are located between the first and second cylinder block segments 32, 33 and the respective faces 34, 35 of those cylinder block segments. The inwardly extending piston connectors 60 advantageously have two opposing sides facing in opposing circumferential directions, each side adjacent a different one of the faces 34, 35 and shaped to conform to the adjacent face 34, 35. Advantageously, the two opposing sides are in radial planes about longitudinal axis 28, as are the adjacent faces 34, 35.

A connector flange 62 may extend in generally opposing directions from opposing sides of the inner end of the inwardly extending connector 58. Each opposing side of each inwardly extending piston connector 60 is advantageously in a radial plane through longitudinal axis 28 and is thus inclined to abut flat against a face 44 or 45 of pistons 42, 43 during use. Each connector flange 62 may be configured to fit into slot 46 in a different one of the curved pistons 42, 43 so the connector flange 62, inwardly extending piston connectors 60 and housing 58 rotate together about axis 28 as the pistons reciprocate along the toroidal cavities 36. The flange 62 and slot 46 represent illustrate a male projection on the piston connector 60 engaging a female receptacle on the piston. Other connections between the piston connectors 60 and pistons 42, 43 may be used, including the use of a male projection on the pistons mating with a female receptacle on the connector or vice versa.

For slot 46 with the L-shaped cross-section, each connector flange 62 has a base flange extending circumferentially around axis 28 and central shaft portion 50, with a radially outward flange extending from that base flange. The shape of slot 46 and the connector flange 62 are complementary and will vary. The connector flange 62 may enter one of the open ends of the slot on a side of the piston. In use, each of curved pistons 42, 43 are aligned in toroidal cavity 36 of the respective cylinder block segment to align the slots 46 with the connector flange 62 as the cylinder block is inserted into the housing 58.

As shown in FIGS. 1, 3 and 7-8, each first piston 42 is connected to a second piston 43 by connector flanges 62 on inwardly extending piston connectors 60, with the inwardly extending connector having opposing sides that abut the adjacent faces or ends of the pistons connected by the flanges 62. In clockwise rotation, pistons 43 push against the adjacent inwardly extending piston connector 60 which pushes pistons 42 in a clockwise direction. For counterclockwise rotation, pistons 42 push against inwardly extending piston connectors 60 which in turn push against pistons 43. The connector flanges 62 ensure each pair of pistons 42, 43 remain connected to and preferably abutting the inwardly extending connectors to which the pistons are connected. The connector flanges 62 may also pull the connected pistons along the path, but are advantageously not configured to exert much pulling force.

The inwardly extending piston connectors 60 are advantageously continuous along the length of the housing 58 corresponding to the length of the cylinder block 30. The inwardly extending piston connectors 60 may be intermittent and located along longitudinal axis 28 to align circumferentially with each piston 42, 43 and cavity 36 and may extend along an axial length of each piston and cavity—but the intermittent construction may be more difficult to assemble when more pistons are used.

Because the inwardly extending piston connectors 60 extend inward from the housing 58, they do not enter the toroidal piston cavities 36 and instead about the opposing and facing faces 34*a*, 34*b* of two adjacent cylinder block segments 32, 33 to limit the reciprocating travel of the pistons 42, 43. The cross-sectional view of FIG. 3 indicates the contact between the faces 34*a*, 34*b* of the two cylinder block segments 32, 33 occurs at the outer periphery of the cylinder block, but the contact occurs along the more complex shaped face which has toroidal cavities 36 can result in openings when viewed perpendicular to the faces 34, 35 of those cylinder block segments. The openings may be circular in shape but other shapes are also contemplated including but not limited to elliptical and polygonal.

Referring to FIGS. 1 and 4-8, the shaft 22 has opposing ends, preferably orthogonal to longitudinal axis 28. First fluid passages 66*a*, 66*b* (see FIGS. 3 and 6) each may open onto the end 64*a* of the shaft 22, preferably near an outer diameter of central shaft 50 (FIG. 4) and may have a threaded entrance in each fluid passage at the shaft end 64*a*. Each fluid inlet passage 66*a*, 66*b* extends along a length of the shaft 24 and along an inner portion of cylinder block segments 32, 33 and spokes 52 to place an interior end of the fluid passages in fluid communication with a portion of each of the toroidal cavities 36. The fluid passages 64*a*, 64*b* may be formed by drilling. The first fluid passages 66*a*, 66*b* are on the same side of the spokes 52.

Second fluid passages 68*a*, 68*b* may also each open onto the end 64*a* of the shaft 22, preferably near an outer diameter of central shaft 50 and may have a threaded entrance in each fluid passage at the shaft end 64*a*. Each fluid inlet passage 68*a*, 68*b* extends along a length of the shaft 24 and along an inner portion of cylinder block segments 32, 33 and spokes 52 to place an interior end of the fluid passages in fluid communication with a portion of each of the piston cavities 36. The fluid passages 68*a*, 68*b* may be formed by drilling. The second fluid passages 68*a*, 68*b* are on the same side of the spokes 52, but located on the opposing side of those spokes as are first fluid passages 66*a*, 66*b* and may be located radially outward of the first fluid passages 66*a*, 66*b*. The fluid passages 66, 68 may open onto one or end faces 64*a*, 64*b*, or may open onto a side of the shaft 22.

Referring to FIGS. 1, 3 and 4-6, when the shaft 22 is inside the housing 58, a radial bearing 70 with inner and outer races 71*a*, 71*b*, respectively, is interposed between each shaft end 26, 24 and the housing 58. The inner race 71*a* encircles the shafts 22, 24 while the outer race 71*b* is inside the housing 58. Advantageously, the inner race 71*a* of each bearing 70 is press fit to one of the shafts 22, 24 while the outer race is press fit into the housing 58. An enlarged diameter 72 on opposing ends of the housing 58 may form a recess and create a shoulder 74 which abuts the inner race of bearing 70 to position each bearing 70 at a desired location of the housing measured along axis 28, although other positioning mechanisms may be used. The outer race of the bearing 70 also abuts the outer portion of cylinder block segments 32, 33 to restrain position the cylinder block and restrain axial motion along axis 28. Radial ball bearings are believed suitable for the bearing 70 but the bearing type may vary depending on the axial thrust exerted by cylinder block 30. The bearings 70 allow relative rotation between the housing 58 and the shaft 22 and cylinder block 30.

First and second end caps 78 may be secured to the housing 58 with retaining rings 88*a, b*. The end caps may be placed in the housing 58 and disposed medial to the grooves formed on opposite sides of the housing. At least one of the end caps 78 may have a central opening 80 to allow access to the ends 64*a*, 64*b* of the shaft ends 22, 24. An outer, housing cap seal 82 is advantageously interposed between the outer periphery of the end cap 78 and the housing 58 or outer bearing race 71*b*. An inner, shaft cap seal 84 is advantageously interposed between each shaft end 22, 24 and the opening 80 in each end cap 78. A retainer clip 88*a*, 88*b* may resiliently engage the grooves formed in the interior of housing 58 to form a removable barrier to axial movement of the parts between the retainer clips 88*a, b*. Other ways of limiting axial movement of the parts between the retaining clips 88*a*, 88*b* other than use of the retaining clips 88*a*, 88*b* are also contemplated including but not limited threaded components, welding, and adhesive.

During use of the rotary actuator 20, the shaft 22 may be restrained from rotation, forcing the housing 58 to move with the curved pistons 42, 43. Thus, in use the actuator shaft 22 is restrained from rotation by any suitable mechanism, usually by an actuator mount 86 that connects the shaft 22 to a base or support that does not rotate. Likewise, to obtain useful motion from the actuator housing 58, the actuator housing 58 must be connected to a driven device by some structure. In some applications the housing 58 itself may be the driven element but in other applications a connecting structure may be used, such as housing connector 89 which is shown as an elongated member with one end connected to the housing 58 and another end adapted to connect to a driven device or an intermediate connecting mechanism. The housing connector 89 may connect to the housing 58 in a non-rotating manner, with any desired stiffness or flexibility in the connection. The housing connector 89 may be rotatably connected to the housing in which event the end of the connector 89 connected to the housing 58 would move along an arc as the housing rotates about axis 28. A variety of different housing connectors 89 or other connections with the rotating housing 58 may be used, depending on the application, including various flanges connected to or formed as part of the housing 58 and extending in various directions outward from the housing. Radial and tangential connections with the housing 58 are believed suitable.

Referring to FIGS. 1-12, the operation of the rotary actuator is described. A source of pressurized fluid (e.g., reservoir 116) may be connected to first and second pumps 118, 120. The first and second pumps 118, 120 may be a fluidic pump that can pump any fluid suitable to the actuator, such as hydraulic fluid, other liquids or air. The reservoir 116 and fluidic pumps 118, 120 may be fluidically connected to each other via lines 122, 124. The lines 122, 124 may be connected to fluid passages 66, 68, preferably using the threaded inlets on the end 68*b*. The fluid pumps 118, 120, connections to the rotary actuator and the control system are known and not described in detail. Typically, a hydraulic pump in fluid communication with a fluid reservoir provides hydraulic fluid at a predetermined pressure and flow rate to the actuator 20, with the hydraulic flow and pressure being varied to move the curved pistons 32, 33. To rotate the actuator in the counterclockwise direction (i.e., first rotational direction) as described and shown in the drawings, the pump 118 is used to pump fluid to the rotary actuator. To rotate the actuator in the clockwise direction (i.e., second rotational direction) as described and shown in the drawings, the pump 120 may be used to pump fluid to the rotary actuator.

Each of the curved pistons 42, 43 extends partially into and out of the cavity 36 into which each piston 42, 43 extends, each having an interior end facing a closed end of the cavity 36 and creating a chamber between each interior end and the adjacent-facing closed end. The exterior end of the piston is outside of the cylinder block segment and the interior end of the piston is inside the cylinder block segment. Advantageously, the interior end and the closed end of cavity 36 are both radially aligned surfaces so they may abut with a chamber volume of about zero, with the chamber volume increasing as the interior end moves away from the closed end of the cavity 36. Since one piston 42 approaches the closed end of its cavity 36 as the other piston 43 moves away from the closed end of its respective cavity 36, one piston moves into its cavity as the other piston moves out of its cavity relative to the faces 34, 35 onto which the piston cavities open.

Rotation of the housing 58 is achieved by increasing pressure in the portion of cavity 36 located between the spokes 52 and the face 44, 45 of the adjacent curved piston 42, 43, while allowing fluid in the opposing portion of the cavity at the opposing end of the curved piston to escape that opposing cavity. Thus, high pressure is provided to one end of the pistons while low pressure, or low resistance is provided to the opposing end of the piston. The rotation direction is reversed by switching the portions of cavity 36 to which the high and/or low pressure or low resistance are applied.

In more detail, a first chamber 90 is formed in the toroidal cavity 36 between the front face 44*a* of piston 42 and the adjacent face of spoke 52*a* while an opposing second chamber 92 is formed in the toroidal cavity 36 between the face 45*b* of piston 43 and the face of the adjacent spoke 52*b*. A third chamber 94 is formed in the toroidal cavity 36 between the face 44*a* of piston 42 and the adjacent face of spoke 52*a*, with an opposing fourth changer 93 formed in the toroidal cavity 36 between the face 45*b* of piston 43 and the adjacent face of spoke 52*b*. Chambers 90, 92 are on opposing ends of paired and connected pistons 42, 43, while chambers 94, 93 are also on opposing ends of paired and connected pistons 42, 43. When the closed ends of the toroidal cavities 36 are in the radial plane (formed by opposing sides of spokes 52*a*, 52*b*), and when the adjacent end of each piston 42*a*, 42*b*, 43*a*, 43*b* forming a chamber is in a radial plane, then the chambers 90, 92, 94, 93 each comprises a radial segment of the toroidal cavity 36.

The pistons 42, 43, move relative to the spokes 52*a*, 52*b*. Increasing pressure in chambers 90, 94 while allowing pressure in opposing chambers 92, 93 to decrease or become a vacuum, rotates pistons 42, 43 and housing 58 counterclockwise. Increasing pressure in chambers 92, 93 while allowing pressure in opposing chambers 90, 94 to decrease or become a vacuum, rotates pistons 42, 43 and housing 58, clockwise.

First fluid passages 66*a*, 66*b* are in fluid communication with chambers 94, 93, respectively, on opposing ends of a first pair of connected pistons 42, 43. Second fluid passages 68*a*, 68*b* are in fluid communication with chambers 92, 90, respectively, on opposing ends of a second pair of connected pistons 42, 43. Thus, pumping fluid through first fluid passage 66*a* to chamber 94, while releasing pressure or applying negative pressure to the opposing chamber 93 by allowing fluid to exit through passage 66*b*, will cause the housing to rotate counterclockwise. Reversing the flow direction through the fluid passages 66*b*, 66*a* and associated chambers 93, 94, respectively, will cause the pistons and housing 58 to rotate clockwise. Because the other pair of pistons 42, 43 are connected to the housing 58, the pressure in chambers 90, 92 should be increased and decreased to achieve the same motion caused by chambers 94 and 93. Pumping fluid through the fluid passage 68*a* and into chamber 92 while allowing fluid to flow out of or applying a negative pressure to the fluid passage 68*b* and chamber 90, causes the associated pistons 42, 43 to rotate clockwise. Pumping fluid through the fluid passage 68*b* and into the chamber 90 while allowing fluid to flow out of or applying a negative pressure to the fluid passage 68*a* and chamber 92, causes the associated pistons 42, 43 and housing 58 to rotate counterclockwise. The piston seals 40 mitigate or prevent fluid leakage from the fluid moving the pistons 42, 43 while the housing cap seal 82 and shaft cap seal 84 mitigate or prevent fluid leakage along the shaft 22. Hydraulic fluid is believed suitable and preferred for most applications, with high pressure hosing used between the pump and actuator 20 in those applications where the pressure is sufficiently high to warrant it.

Figure 11:
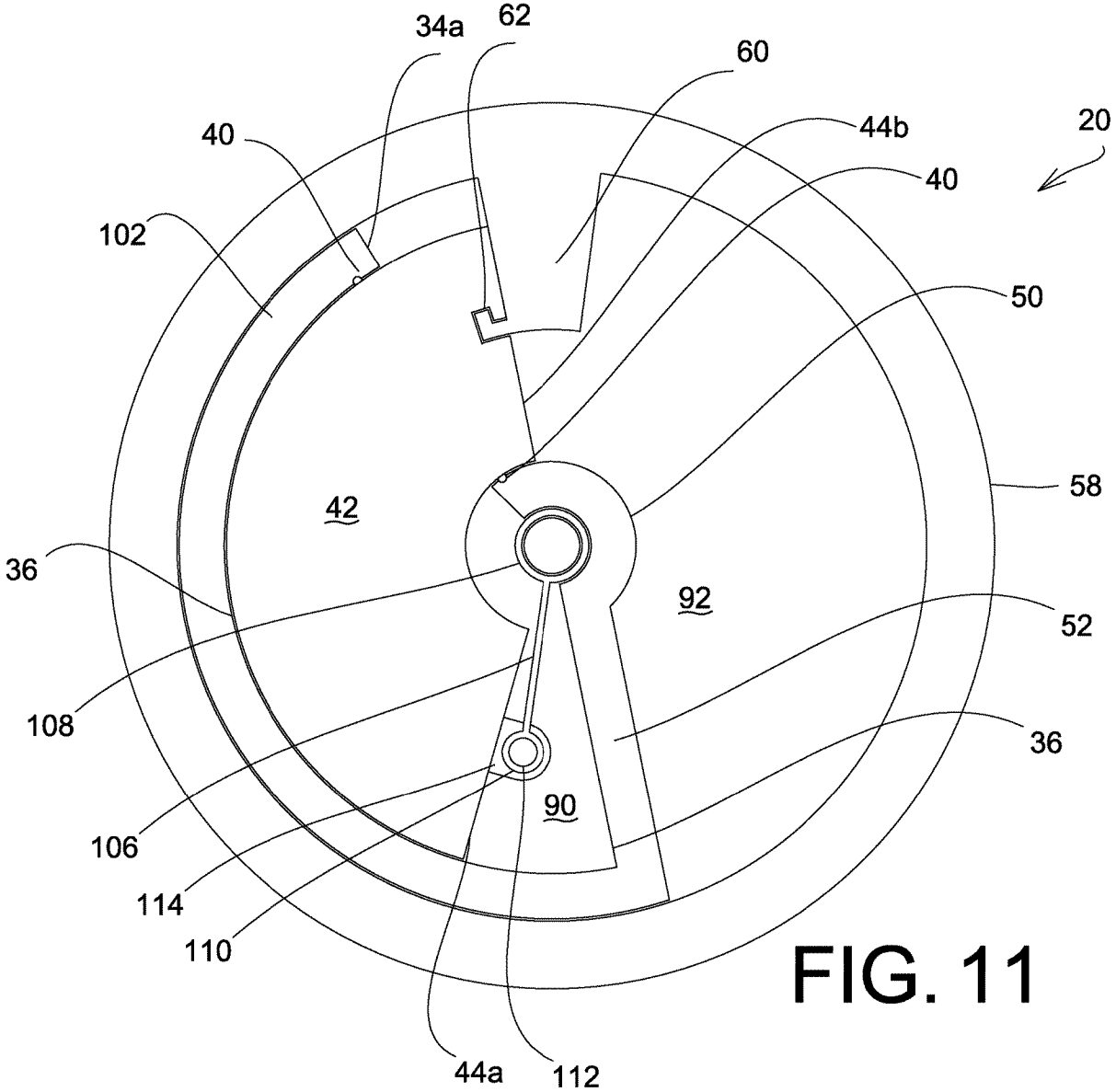
FIG. 11 is a sectional view of a single segment, single piston rotary actuator.
Figure 12:
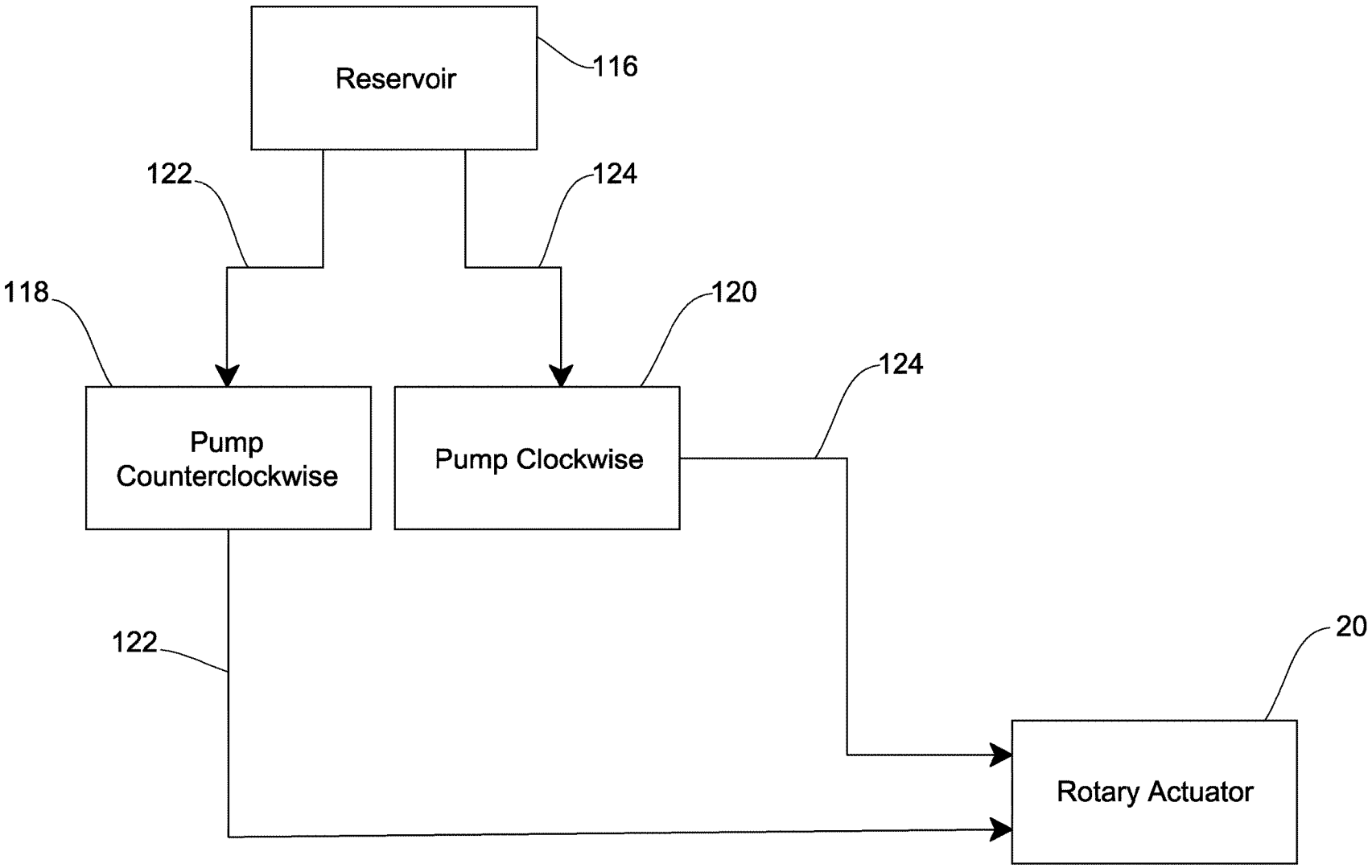
FIG. 12 is a schematic diagram of the rotary actuator in a system.

For a rotary actuator with six pairs of toroidal cavities 36, as shown in FIG. 1, each pair may contain a pair of pistons 42, 43, the use of pistons subtending an arc 55 of about 55° is believed suitable, to achieve a rotation of housing 58 of about 32°. The amount of rotational force provided by the rotary actuator may be varied by varying the cross-sectional diameter of the curved pistons 42, 43, or by varying the number of paired pistons 42, 43 (e.g., increasing the length to accommodate more pistons), or by varying the pressure applied to the chambers 90, 92, 94, 96. The amount of rotation may be varied by altering the length of the curved pistons and the travel of inwardly extending piston connectors 60 between adjacent faces 34, 35 of the cylinder block segments 32, 33. If limited rotation but great power is required, the use of two pairs of pistons 42, 43 may be increased. If more rotation is required, the use of two pairs of pistons 42, 43 may be reduced to a single pair of pistons. By way of example and not limitation, FIG. 11 shows a single pair of pistons embodiment.

The pistons 42, 43 are advantageously segments of a torus. The pistons may be made of metal (e.g., aluminum, steel, titanium), plastics or any other material suitable for the specific application. The pistons may be formed by cutting a preformed torus to the desired arc-length, or by bending a rod (hot or cold) of a selected diameter and shaping the surface to the desired cross-sectional shape (e.g., circular) by sanding, grinding, machining, polishing, plasma cutting, 3D printing and other methods. Plastics may be injection molded and polished or abraded to the desired contour and surface roughness. Metals may be cast, forged or machined to shape and surface finished to the desired contour and surface roughness.

The rotary actuator 20 is believed to provide a large rotational force for a small size, and is believed to allow small diameter actuators providing much larger force than existing rotary actuators. The depicted embodiment uses two pairs of pistons 42, 43, but each pair is in a separate pair of toroidal cavities 36 separated by spokes 52*a*, 52*b*. As such, only one pair of pistons 42, 43 in one pair of toroidal cavities 36 may be provided, recognizing that the resulting force will be less. Similarly, two pairs of pistons 42, 43 may be provided in separate pair of cavities 36. One or both pairs of pistons may be driven by hydraulic fluid, with the spokes 52*a*, 52*b* moving the unpowered pistons along their respective pair of toroid cavities. Further, two pairs of pistons 42, 43 may be provided, each in a separate pair of cavities 36, but one pair of pistons may be connected to a first pump, reservoir and fluid system to move the housing 58 in a first rotational direction, while the second pair of pistons is connected to a second pump, reservoir and fluid system to move the housing 58 in an opposing, second rotational direction, with the non-used hydraulic pump and pistons opened to minimize resistance to fluid movement by the driving pistons and pump. Because the rotary actuator 20 is moved by hydraulic fluid, it is believed to provide a stiff actuator with the valving on the hydraulic system preventing fluid movement so the pistons 42, 43 resist movement of the housing 58 and any component connected to the housing.

Additionally, the curved pistons 42, 43 move along a curved path and thus allow a greater travel length in a smaller diameter than other hydraulic actuators and existing rotary actuators. It is believed the pistons 42, 43 may have a travel length equal to or greater than the diameter of the cylinder block 30, and possibly equal to or greater than the diameter of the housing 58. The use of pistons 42, 43 with a circular cross-section in conjunction with cavities 36 having a circular cross section and sealing rings 40 having a circular periphery, may be used. However, it is also contemplated that other shapes of the cross sections may be utilized including but not limited to elliptical, polygonal.

In use, the shaft 22 of the rotary actuator 20 is connected to a base or other support so the shaft and the cylinder block 30 which is a part of the shaft rotates relative to the housing 58. Because the cylinder block has a greater diameter than the shaft ends, the cylinder block increases torsional stiffness to a level greater than if the shaft maximum diameter were to be equal to an outer diameter of the shaft ends. A source of pressurized fluid is connected to the fluid passages 66*a*,

66*b* and/or 68*a*, 68*b* so as to increase pressure in a chamber behind at least one first pair of pistons 42, 43 while either decreasing the pressure in a chamber in front of the at least one pair of pistons or evacuating the pressure in the chamber in front of the at least one pair of pistons. The pressure differential in the two chambers moves the at least one pair of first pistons along the segment of the toroidal path in which the pistons are placed. At least one and preferably the at least one first pair of pistons are connected to the housing 58 (e.g., by inwardly extending piston connector 60) so the housing rotates with the pistons. The inwardly extending piston connector 60, or the leading end of the at least one first pair of pistons may abut the end of the toroidal chamber 36 in which the pistons travel in order to limit the amount of rotation. The pressure in the chambers on opposing ends of the at least one first pairs of pistons may be switched in order to move the actuator the other way, or a second pair of pistons in a second toroidal chamber may be pressurized in the reverse manner as the at least one first pair of pistons to rotate the housing in an opposite direction.

In the above embodiment, the shaft 22, cylinder block 30 and toroidal cavities 36 are stationary and centered along longitudinal axis 28. The housing 58, inwardly extending connector 52 and curved pistons 42, 43 rotate together, about longitudinal axis 28 of shaft 22, with bearings 70 allowing that rotation. The alignment of the housing 70, inwardly extending connector 52 and curved pistons relative to the longitudinal axis 28 is critical to ensure the curved pistons move along the toroidal piston cavities 36. It is also contemplated that the housing 58, pistons 42, 43 and connectors 60 may be stationary while the shaft 22 rotates.

While two, cylinder block segments 32, 33 are described, more or less could be used. But as more segments are added the arc length of the travel of the pistons is reduced, although the number of chambers increases and thus the potential force increases. It is believed that more than 3 or 4 cylinder block segments are possible, but not desirable unless the diameter of the actuator 20 is increased. For a given arc length, the length of the piston travel will increase linearly with the diameter. Thus, it is believed possible to increase the diameter of the housing 58 and thereby increase the number of cylinder block segments. The desired force applied by the actuator 20 may be varied by the number of cylinder block segments and the number, size and travel length of the curved pistons.

Referring to FIG. 11, a single cylinder block segment 32 may also be used for the rotary actuator 20 along with only one first curved piston 42 reciprocating in its toroidal cavity 36 formed within the cylinder block segment, with no other cylinder block segments in the same orthogonal section of the actuator 20. A plurality of curved pistons 42 may extend along the longitudinal axis 28, or only one curved piston may be used as shown in FIG. 11 and described herein. Because many parts are as previously described those parts will be referred to with the same part number.

Piston connector 60 extends inward from housing 58 with its connector flange 62 connecting to the piston 42 through the second piston face 44*b*. The spoke 52 has an inner end encircling at least a portion of the central shaft 50 so the single cylinder block segment 102 rotates about the shaft 50 and its longitudinal axis 28. The housing 58 and central shaft 50 are connected to different parts or apparatus so at least one of those parts rotates relative to the other part as in the above described embodiments. In the depicted embodiment of FIG. 11, the central shaft 50 is advantageously stationary and provides the fluid connections to reciprocate the curved piston 42 within the toroidal cavity 36.

In operation, if shaft 50, spoke 52 and single cylinder block segment 102 are stationary, then fluid entering the first chamber 90 will push against face 44*a* of curved piston 42 to move the curved piston 42 out of the toroidal chamber 36 which causes the piston 42 to rotate clockwise and also rotate piston connector 60 and housing 58 clockwise—in the orientation of FIG. 11. Fluid entering the second cavity 92 exerts force on face 44*b* of the curved piston 42 and causes that curved piston 42 to rotate counterclockwise which in turn causes the connected spoke 60 and housing 58 to rotate counterclockwise.

Referring to FIG. 11, a single segment link assembly may be introduced to radially stabilize the end of each piston 42 within the toroidal cavity 36. The link assembly includes a rod 106 having a first, inner end 108 rotatably connected to the central shaft 50 and a second, outer end 110 rotatably connected to the unexposed end of the piston 42. In the depicted embodiment the inner end 108 encircles a portion of the shaft 50 and the outer end 110 encircles a post 112 extending from a mounting support 114 extending perpendicular to the face 44*a* of the piston 42 at the center of the face 44*a*. The rod 106 extends radially inward such that radial distance between the piston 42 and the single cylinder block 102 is held constant relative to their common longitudinal axis 28 through the center shaft 50. The support 114 advantageously extends from the face 44*a* of the curved piston 42 a distance sufficient to keep the rod 106 from hitting a corner of the 42. The link assembly implemented in the single segment version shown in FIG. 11 may also be implemented in the multi segment version which is shown in FIGS. 1-10.

This arrangement of the rod 106 is believed to counter radial forces acting on the piston 42 to reduce and preferably eliminate contact friction between the toroidal cavity 36 and the curved piston 42 to achieve a constant torque output of the actuator through its operating range.

The above description is given by way of example, and not limitation. While the cavities 36 are referred to as toroidal cavities, they may also be described as curved cavities with a cross-section in a plane orthogonal to the center of the curve. Given the above disclosure, one skilled in the art could devise variations that are within the scope and spirit of the invention. Further, the various features of this invention can be used alone, or in varying combinations with each other and are not intended to be limited to the specific combination described herein.

What is claimed is:

1. A fluid actuated, rotary actuator, comprising:

a shaft defining a longitudinal axis and a cylinder block adjacent to the shaft;

the cylinder block having at least one segment extending along a length of the longitudinal axis;

each segment having at least one toroidal cavity curving around the longitudinal axis, each toroidal cavity located in a plane generally orthogonal to the longitudinal axis;

each toroidal cavity having a closed end internal to the at least one segment and an open end opening to the at least one segment;

at least one curved piston, each piston being curved at the same radius as each toroidal cavity and having a cross section sized and configured to reciprocate along a first circumferential length into and out of the opening;

a housing connected to the shaft by bearings;

the housing having a first connector connected to each piston; and a fluid passage extending to each chamber of a piston.

2. The fluid actuated, rotary actuator of claim 1, wherein each segment of the cylinder block having first and second toroidal cavities, each cavity curving around the longitudinal axis at the same radius and having a cross-section along a first circumferential length of the toroidal cavity;

at least a first pair of curved piston having first and second pistons each curved at the same radius as the toroidal cavities and having a cross section and sized and configured to reciprocate along the first circumferential length into and out of one of the opening and sealing rings, each first and second piston having respective first and second interior ends each facing a different one of the closed ends to define a first chamber between the first interior end and the closed end facing the first interior end, and defining a second chamber between the second interior end and the closed end facing the second interior end, each piston having an exterior end opposite its interior end; and a housing having a cylindrical inner surface connected to first and second ends of the shaft by bearings, the housing having a first inwardly extending connector connected to the exterior end of each piston in the first pair of curved pistons so the housing rotates as the pistons move along the toroidal cavity in which each piston is located, the first inwardly extending connector being located between different faces of the at least one segments of the cylinder block.

3. The fluid actuated, rotary actuator of claim 2, wherein the cylinder block comprises first and second segments each extending along a length of the longitudinal axis and subtending an arc of less than about 170°, each segment having first and second sides facing opposing circumferential directions about the longitudinal axis; and further comprising:

a second pair of curved pistons having third and fourth pistons each curved at the same radius as the toroidal cavities and having a cross section and sized and configured to reciprocate along the first circumferential length into and out of one of the openings and sealing rings to match the cross section of the curved pistons of the second segment, third and fourth piston having respective third and fourth interior ends each facing a different one of the closed ends to define a third chamber between the third interior end and the closed end facing the third interior end, and defining a fourth chamber between the fourth interior end and the closed end facing the fourth interior end; and the housing having a second inwardly extending connector connected to the exterior end of each piston in the second pair of curved pistons so the housing rotates as the second pair of curved pistons move along the toroidal cavity in which each piston in the second pair of curved pistons is located.

4. The fluid actuated, rotary actuator of claim 3, wherein each piston is connected to the inwardly extending connector by a male projection on the connector engaging a female receptacle on the piston, the female receptacle comprises a slot in the piston having a cross-sectional shape that mates with a male projection on the inwardly extending connector.

5. The fluid actuated, rotary actuator of claim 3, wherein each of the chambers comprises a radial segment of the toroidal cavity.

6. The fluid actuated, rotary actuator of claim 3, wherein each inwardly extending connector has two opposing sides, each extending along a plane through a length of the longitudinal axis.

7. The fluid actuated, rotary actuator of claim 3, wherein first and second faces of each cylinder block segment lie substantially in a radial plane extending along a length of the longitudinal axis.

8. The fluid actuated, rotary actuator of claim 3, further comprising a housing connector having first and second ends, the first end being rotatably connected to the housing.

9. The fluid actuated, rotary actuator of claim 3, wherein the housing has a cylindrical outer surface with opposing ends, and further comprising:

an end cap on each end of the housing;

a fluid seal interposed between each end cap and one of the housing or bearings; and a fluid seal interposed between each end cap and a different end of the shaft.

10. The fluid actuated, rotary actuator of claim 3 wherein the cylindrical inner surface rotates relative to and outside of the outer surface of at least one segment of the cylinder block.

11. The fluid actuated, rotary actuator of claim 3 wherein the outer surface of at least one segment of the cylinder block rotates relative to and inside of the cylindrical inner surface.

12. The fluid actuated, rotary actuator of claim 1, wherein the shaft is connected to a first surface so the shaft does not rotate about the longitudinal axis and wherein the housing is connected to a part which rotates with the housing.

13. The fluid actuated, rotary actuator of claim 1, wherein the housing is connected to a first surface so the housing does not rotate about the longitudinal axis and wherein the shaft is connected to a part which rotates with the shaft.

14. A method of actuating a fluid actuated rotary actuator, the method comprising the steps of:

providing the fluid actuated rotary actuator, the actuator comprising:

a shaft defining a longitudinal axis and a cylinder block adjacent to the shaft;

the cylinder block having at least one segment extending along a length of the longitudinal axis;

each segment having at least one toroidal cavity curving around the longitudinal axis, each toroidal cavity located in a plane generally orthogonal to the longitudinal axis;

each toroidal cavity having a closed end internal to the at least one segment and an open end opening to the at least one segment;

at least one curved piston, each piston being curved at the same radius as each toroidal cavity and having a cross section sized and configured to reciprocate along a first circumferential length into and out of the opening;

a housing connected to the shaft by bearings;

the housing having a first connector connected to each piston; and a fluid passage extending to each chamber of a piston; and pressurizing the chamber with fluid to traverse the piston out in a direction from the closed end to the open end opening to actuate a flap or aileron.

15. A method of actuating a flap or aileron on an airborne frame, the method comprising the steps of:

providing a fluid actuated rotary actuator mounted to the flap or aileron of the airborne frame, the actuator comprising:

a shaft defining a longitudinal axis and a cylinder block adjacent to the shaft;

the cylinder block having at least one segment extending along a length of the longitudinal axis;

each segment having at least one toroidal cavity curving around the longitudinal axis, each toroidal cavity located in a plane generally orthogonal to the longitudinal axis;

each toroidal cavity having a closed end internal to the at least one segment and an open end opening to the at least one segment;

at least one curved piston, each piston being curved at the same radius as each toroidal cavity and having a cross section sized and configured to reciprocate along a first circumferential length into and out of the opening;

a housing connected to the shaft by bearings;

the housing having a first connector connected to each piston; and a fluid passage extending to each chamber of a piston; and pressurizing the chamber with fluid to traverse the piston out in a direction from the closed end to the open end opening to actuate the flap or aileron.

* * * * *